US005772531A

United States Patent [19]

Ohsumi et al.

[11] Patent Number: 5,772,531

[45] Date of Patent: Jun. 30, 1998

[54] SOLID GOLF BALL

[75] Inventors: Shunji Ohsumi; Hiroshi Kawabata; Kenji Baba; Yasuhiro Fukui; Hiroyuki Naito; Taro Izawa, all of Kagawa-ken, Japan

[73] Assignee: Kasco Corporation, Kagawa-ken, Japan

[21] Appl. No.: 813,068

[22] Filed: Mar. 7, 1997

[30] Foreign Application Priority Data

Nov. 1, 1996 [JP] Japan ..... 8-292100
Nov. 1, 1996 [JP] Japan ..... 8-292101

[51] Int. Cl.[6] ..... A63B 37/06; A63B 37/12

[52] U.S. Cl. ..... 473/376; 473/373; 473/378

[58] Field of Search ..... 473/361, 373, 473/374, 376, 377, 378

[56] References Cited

U.S. PATENT DOCUMENTS 5,439,227 8/1995 Egashira et al. ..... 473/373
5,674,137 10/1997 Maruko et al. ..... 473/361

FOREIGN PATENT DOCUMENTS 60-241464 11/1985 Japan .

*Primary Examiner*—George J. Marlo
*Attorney, Agent, or Firm*—Oblon, Spivak, McClelland, Maier & Neustadt, P.C.

[57] ABSTRACT

Disclosed is a solid golf ball comprising a solid core having a three-layered structure composed of an inner layer, an intermediate layer, and an outer layer, and a cover for coating the solid core. The intermediate layer is designed to have a JIS-C hardness of 50 to 80, and the outer layer is designed to have a hardness which is higher than the hardness of the intermediate layer.

13 Claims, 2 Drawing Sheets

SOLID GOLF BALL

BACKGROUND OF THE INVENTION

1. Field of the Invention

The present invention relates to a solid golf ball comprising a solid core having a three-layered structure coated with a cover.

2. Description of the Related Art

A two-piece solid golf ball is generally known, in which a solid core having a single-layered structure is coated with a cover. Such a two-piece solid golf ball can provide a long carry. However, the two-piece solid golf ball has a drawback in that a hard feeling is given when the ball is hit. In order to improve the drawback of the two-piece solid golf ball, a three-piece solid golf ball comprising a solid core having a two-layered structure has been developed.

For example, a three-piece solid golf ball is disclosed in Japanese Laid-Open Patent Publication No. 60-241464, in which a solid core is divided into two. Namely, the solid core comprises an inner core and an outer core. The inner core has a JIS-C hardness of 50 to 70, and the outer core has a JIS-C hardness of 70 to 90. Thus it is intended to give a soft hitting feeling by using the soft inner core and the hard outer core.

However, in the case of the golf ball as described above, when a large striking force is exerted on the golf ball and even the inner core undergoes deformation of the ball, it is impossible to put suitable spin on the ball in order to obtain an optimum ballistic curve. As a result, an inconvenience arises in that the carry is lowered. Further, when a shot is performed such that an outer portion of the ball is locally deformed, it is impossible to always obtain a good hitting feeling, due to the influence caused by the hardness of the outer core.

SUMMARY OF THE INVENTION

A general object of the present invention is to provide a solid golf ball which makes it possible to obtain a sufficient carry and a soft hitting feeling.

A principal object of the present invention is to provide a solid golf ball which makes it possible to put suitable spin on the ball so that an optimum ballistic curve is obtained.

Another object of the present invention is to provide a solid golf ball which makes it possible to suppress distortion or deformation of the ball upon making a shot.

Still another object of the present invention is to provide a solid golf ball which makes it possible to obtain high resilience.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
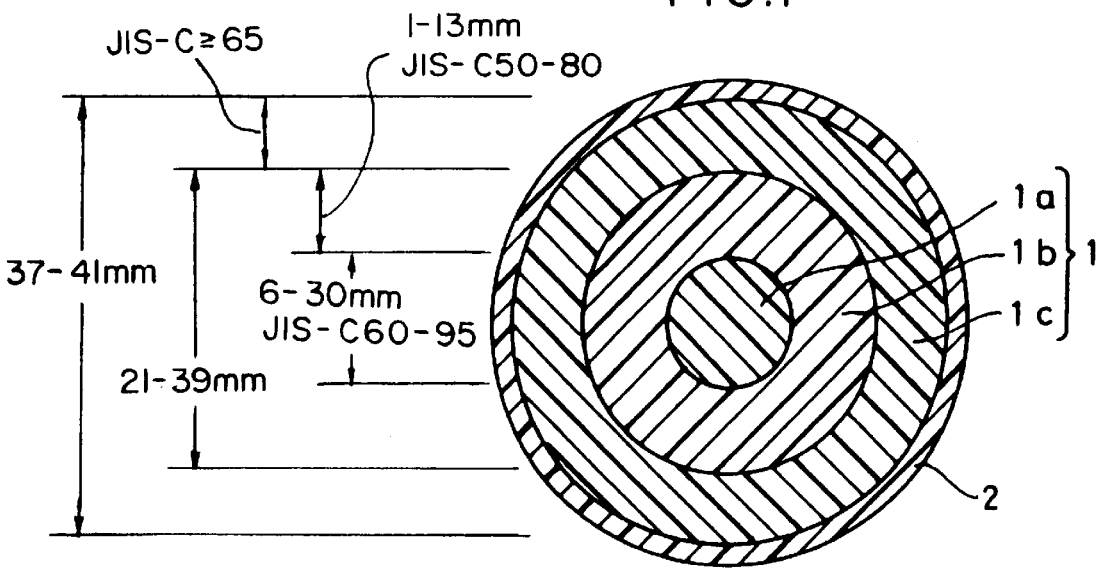
FIG. 1 shows a cross-sectional structure of a solid golf ball according to the first invention.

As shown in FIG. 1, a solid golf ball according to the first invention has its cross-sectional structure comprising a solid core 1 composed of three layers, and a cover 2 for coating the solid core 1.

The solid core 1 comprises an inner layer 1*a*, an intermediate layer 1*b* having a JIS-C hardness of 50 to 80, and an outer layer 1*c* having a hardness which is higher than the hardness of the intermediate layer 1*b*.

If the hardness of the intermediate layer 1*b* is lower than a JIS-C hardness of 50, the golf ball becomes excessively soft. As a result, the resilience is deteriorated, and the carry is lowered. On the contrary, if the hardness of the intermediate layer 1*b* is higher than a JIS-C hardness of 80, the golf ball becomes excessively hard. As a result, the hitting feeling is deteriorated. Even when the intermediate layer 1*b* has a JIS-C hardness of 50 to 80, if the hardness of the outer layer 1*c* is lower than the hardness of the intermediate layer 1*b*, it becomes impossible to obtain a sufficient carry.

The inner layer 1*a* is formed to be relatively hard. However, in some cases, the inner layer 1*a* may have a hardness lower than the hardness of the intermediate layer 1*b*. Preferably, the inner layer 1*a* has a JIS-C hardness of 60 to 95. Preferably, the outer layer 1*c* has a JIS-C hardness of not less than 65.

Each of the layers of the solid core 1 is usually formed of a rubber composition comprising a base material composed of a natural rubber or a synthetic rubber. However, it is also possible to use a material containing, for example, an ionomer resin and a thermoplastic elastomer composed of styrene, olefin, urethane, ester, or amide.

In the first invention, it is preferable that the intermediate layer 1*b* has a thickness of 1 to 13 mm, and the inner layer 1*a* and the intermediate layer 1*b* have a combined diameter of 21 to 39 mm. It is allowable to alter these ranges to some extent. Usually, the inner layer 1*a* has a diameter of about 6 to 30 mm, and the solid core 1 has a diameter of about 37 to 41 mm. However, there is no limitation to these ranges. If the size (diameter or thickness) of each of the layers of the solid core 1 is greatly deviated from the ordinary size, it is impossible to obtain a suitable distribution of hardness in the solid core 1, and it is impossible to obtain the effect of the first invention.

Preferably, the solid golf ball according to the first invention is produced in accordance with a specification for the solid core 1 as shown in Table 1, when the inner layer 1*a* of the solid core 1 has a diameter of 6 to 17 mm.

TABLE 1

| | | Diameter (mm) | Thickness (mm) | Hardness (JIS-C) |
|---|---|---|---|---|
| Inner layer | 1 a | 6 ~ 17 | | 65 ~ 95 |
| Intermediate layer | 1 b | | 2 ~ 13 | 50 ~ 75 |
| | 1 a + 1 b | 21 ~ 32 | | |
| Outer layer | 1 c | | | not less than 65 higher than hardness of 1b |
| | 1 a + 1 b + 1 c | 37 ~ 41 | | |

In order to suppress excessive distortion or deformation caused by a shot in which the ball is greatly distorted or deformed, it is preferable that the hardness of the inner layer 1*a* is higher than the hardness of the intermediate layer 1*b*. Even when the hardness of the inner layer 1*a* is increased, the hitting feeling is soft, because the inner layer 1*a* has a small diameter. The solid golf ball, which comprises the solid core 1 produced in accordance with the specification described above, makes it possible to put suitable spin on the ball especially in the case of a shot in which the distortion or deformation of the ball is large. Accordingly, the carry is not lowered.

Further, the solid golf ball according to the first invention is preferably produced in accordance with a specification for the solid core 1 as shown in Table 2, when the inner layer 1*a* of the solid core 1 has a diameter of 17 to 30 mm.

TABLE 2

| | | Diameter (mm) | Thickness (mm) | Hardness (JIS-C) |
|---|---|---|---|---|
| Inner layer | 1 a | 17 ~ 30 | | 60 ~ 90 |
| Inter-mediate layer | 1 b | | 1 ~ 11 | 55 ~ 80 |
| | 1 a + 1 b | 28 ~ 39 | | |
| Outer layer | 1 c | | | not less than 65 higher than hardness of 1b |
| | 1 a + 1 b + 1 c | 37 ~ 41 | | |

The solid golf ball according to the specification shown in Table 2 has a large diameter of the inner layer 1*a* as compared with the solid golf ball according to the specification shown in Table 1. Therefore, the inner layer 1*a* preferably has a low hardness. Further, in the former solid golf ball, the intermediate layer 1*b* is arranged at an outer portion as compared with the latter solid golf ball. Therefore, the intermediate layer 1*b* preferably has a high hardness. The solid golf ball comprising the solid core 1 according to the specification shown in Table 2 gives a good hitting feeling especially in the case of a shot in which the distortion or deformation of the ball is small.

As described above, the two types of solid golf balls having different characteristics are obtained depending on the specification for the solid core 1. However, the high resilience is obtained by using any of them, and there is no deterioration of the ballistic curve, which would be otherwise caused by decrease in number of spinning rotation, owing to the solid core 1 having the three-layered structure comprising the inner layer 1*a*, the intermediate layer 1*b* having the JIS-C hardness of 50 to 80, the outer layer 1*c* having the hardness higher than the hardness of the intermediate layer 1*b*. Therefore, a sufficient carry is obtained. Moreover, a soft hitting feeling is obtained owing to the soft intermediate layer 1*b*.

Figure 2:
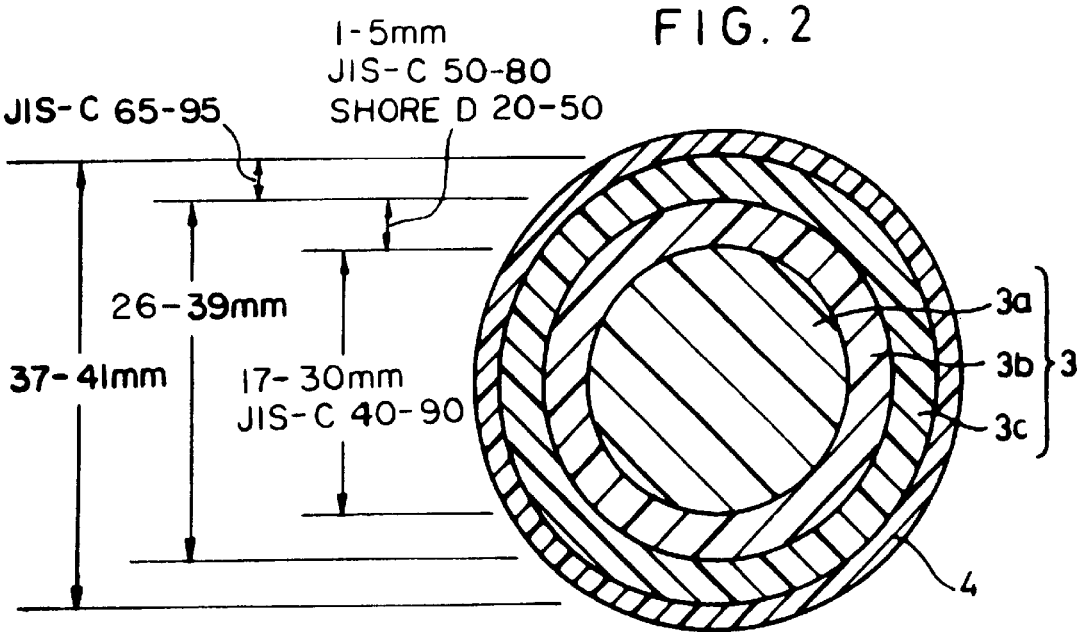
FIG. 2 shows a cross-sectional structure of a solid golf ball according to the second invention.

As shown in FIG. 2, a solid golf ball according to the second invention has its cross-sectional structure comprising a solid core 3 composed of three layers, and a cover 4 for coating the solid core 3.

The solid core 3 comprises an inner layer 3*a* having a JIS-C hardness of 40 to 90, an intermediate layer 3*b* formed of a thermoplastic resin composition and having a JIS-C hardness of 50 to 80, and an outer layer 3*c* having a JIS-C hardness of not less than 65.

The intermediate layer 3*b* is formed from a composition comprising a component of a thermoplastic resin, not from a polybutadiene rubber composition as used for the conventional solid core. Those usable as the thermoplastic resin include, for example, an ionomer resin and a thermoplastic elastomer composed of styrene, olefin, urethane, ester, or amide. However, it is preferable to use those having a characteristic that the lower the hardness is, the higher the resilience is. For example, it is preferable to use a thermoplastic polyamide elastomer. It is preferable to use those having a Shore D hardness of 20 to 50 as the thermoplastic resin. If those having a Shore D hardness higher than 50 are used, the intermediate layer 3*b* has a high hardness. Therefore, the hitting feeling is deteriorated, and the resilience of the ball is deteriorated in some cases. The blending amount of the thermoplastic resin is not especially limited. However, the thermoplastic resin is blended in an amount of not less than 50% by weight with respect to a total weight of the composition. The thermoplastic resin composition may be blended with, for example, a filler, a coloring agent, an anti-aging agent, and a dispersing agent, if necessary.

When the inner layer 3*a* is soft, the carry may be lowered in the case of a shot in which the distortion or deformation of the ball is large. However, the shortage of carry is supplemented by the high resilience of the intermediate layer 3*b*. Accordingly, the hardness of the inner layer 3*b* can be lowered up to a JIS-C hardness of 40. On the other hand, the solid golf ball is provided with the intermediate layer 3*b* having the low hardness. Therefore, the hitting feeling is not deteriorated even when the hardness of the inner layer 3*a* is raised up to a JIS-C hardness of 90.

Even when the hardness of the outer layer 3*c* is lowered up to a JIS-C hardness of 65, a sufficient carry is obtained, because the solid golf ball is provided with the intermediate layer 3*b* having the high resilience. If the hardness of the outer layer 3*c* is excessively high, the hitting feeling is deteriorated. Therefore, it is preferable that the outer layer 3*c* has a JIS-C hardness of 65 to 97.

Preferably, the inner layer 3*a* and the outer layer 3*c* are composed of rubber compositions comprising a base material of cis-1,4-polybutadiene which is used for the conventional solid core. However, the outer layer 3*c* can be also formed of a thermoplastic resin composition containing, for example, an ionomer resin or a thermoplastic elastomer.

In the second invention, it is preferable that the intermediate layer 3*b* has a thickness of 1 to 5 mm, and the inner layer 3*a* and the intermediate layer 3*b* have a combined diameter of 26 to 39 mm. These ranges can be altered to some extent. However, if these ranges are greatly altered, it is impossible to obtain the effect of the second invention. In the second invention, the inner layer 3*a* may have a diameter of about 17 to 30 mm, and the solid core 3 may have a diameter of about 37 to 41 mm. However, there is no limitation to these ranges.

In order to produce the solid cores 1, 3 according to the first and second inventions, for example, it is possible to use a method equivalent to the conventional method for producing a solid core having a two-layered structure. Namely, the rubber composition for the inner layer 1*a* or 3*a* is heated and molded in a mold under a pressurized condition to form the inner layer 1*a* or 3*a*. The obtained inner layer 1*a* or 3*a* is coated with hemispherical shells formed from the resin composition for the intermediate layer 1*b* or 3*b*, followed by heating and molding in a mold under a pressurized condition to produce the intermediate layer 1*b* or 3*b*. Next, the outer layer 1*c* or 3*c* is produced in the same manner as the intermediate layer 1*b* or 3*b*. Further, the resin composition to be used for the intermediate layer 1*b* or 3*b* may be molded by using an injection molding machine for thermoplastic resins. Therefore, the intermediate layer 1*b* or 3*b* and the outer layer 1*c* or 3*c* can be produced by means of injection molding.

The cover 2 or 4 for coating the solid core 1 or 3 can be formed of a resin composition comprising a base material of an ionomer resin used for the conventional solid golf ball. The cover 2 or 4 can have a thickness approximately equivalent to those used for the conventional golf ball (usually, 1.3 to 2.8 mm).

EXAMPLES 1 TO 5 CONCERNING THE FIRST INVENTION AND COMPARATIVE EXAMPLES 2 AND 3

Rubber compositions for inner layers 1*a,* intermediate layers 1*b,* and outer layers 1*c* blended as shown in Table 3 were used to produce solid cores 1 of the three-layered structure having diameters, weights, and hardnesses as shown for Examples 1 to 5 and Comparative Examples 2 and 3 in Table 4. A resin composition for a cover 2 was prepared by blending 1.5 part by weight of titanium dioxide with respect to 100 parts by weight of an ionomer resin. Each of the solid cores 1 was coated with the prepared resin composition for the cover 2, followed by being subjected to polishing and painting to produce solid golf balls concerning Examples 1 to 5 and Comparative Examples 2 and 3.

In Table 4, symbols are as follows:

*1 (carry), *2 (number of spinning rotation): measured by striking the ball by using a swing robot with a wood No. 1 club (1W) at a club head speed of 40 m/sec;

*3 (hitting feeling): evaluated by hitting the ball by an expert golfer (man) with a wood No. 1 club (1W) and an iron No. 9 club (9I); ◎→extremely good, ○→good, X→bad.

COMPARATIVE EXAMPLE 1

A conventional two-piece solid golf ball was produced by using a rubber composition blended as shown in Table 3 to prepare a solid core having a single-layered structure, and coating the prepared solid core with the resin composition for a cover as used in Examples 1 to 5 and Comparative Examples 2 and 3, followed by being subjected to polishing and painting.

The carry, the number of spinning rotation, and the hitting feeling were investigated and shown in Table 4 for the solid golf balls concerning Examples 1 to 5 and Comparative Examples 1 to 3. As shown in Table 4, the solid golf balls concerning Examples 1 to 5 gave carries approximately equivalent to a carry given by using the conventional

TABLE 3

| | | Example | | | | | Comparative Example | | |
|---|---|---|---|---|---|---|---|---|---|
| | | 1 | 2 | 3 | 4 | 5 | 1 | 2 | 3 |
| Rubber composition for inner layer 1a | Polybutadiene | 100 | 100 | 100 | 100 | 100 | | 100 | 100 |
| | Zinc acrylate | 25 | 25 | 30 | 30 | 13 | | 15 | 35 |
| | Zinc oxide | 60 | 60 | 5 | 5 | 65 | | 28 | 19 |
| | Anti-aging agent | 0.5 | 0.5 | 0.5 | 0.5 | 0.5 | | 0.5 | 0.5 |
| | Peroxide | 1.5 | 1.5 | 1.5 | 1.5 | 1.5 | | 1.5 | 1.5 |
| Rubber composition for intermediate layer 1b | Polybutadiene | 100 | 100 | 100 | 100 | 100 | | 100 | 100 |
| | Zinc acrylate | 13 | 13 | 13 | 13 | 20 | | 35 | 25 |
| | Zinc oxide | 65 | 65 | 65 | 65 | 30 | | 19 | 24 |
| | Anti-aging agent | 0.5 | 0.5 | 0.5 | 0.5 | 0.5 | | 0.5 | 0.5 |
| | Peroxide | 1.5 | 1.5 | 1.5 | 1.5 | 1.5 | | 1.5 | 1.5 |
| Rubber composition for outer layer 1c | Polybutadiene | 100 | 100 | 100 | 100 | 100 | 100 | 100 | 100 |
| | Zinc acrylate | 28 | 28 | 30 | 30 | 30 | 30 | 25 | 15 |
| | Zinc oxide | 5 | 5 | 5 | 5 | 5 | 20 | 24 | 28 |
| | Anti-aging agent | 0.5 | 0.5 | 0.5 | 0.5 | 0.5 | 0.5 | 0.5 | 0.5 |
| | Peroxide | 1.5 | 1.5 | 1.5 | 1.5 | 1.5 | 1.5 | 1.5 | 1.5 |

TABLE 4

| | | | Example | | | | | Comparative Example | | |
|---|---|---|---|---|---|---|---|---|---|---|
| | | | 1 | 2 | 3 | 4 | 5 | 1 | 2 | 3 |
| Core | Diameter (mm) | 1a | 8.0 | 12.0 | 22.0 | 25.0 | 22.0 | | 25.0 | 25.0 |
| | | 1a + 1b | 25.0 | 25.0 | 32.5 | 32.5 | 32.5 | | 32.5 | 32.5 |
| | | 1a + 1b + 1c | 38.3 | 38.3 | 38.3 | 38.3 | 38.3 | 38.3 | 38.3 | 38.3 |
| | Weight (g) | 1a | 0.3 | 1.2 | 6.0 | 9.8 | 6.0 | | 8.8 | 8.8 |
| | | 1a + 1b | 10.6 | 10.8 | 21.8 | 22.0 | 21.8 | | 21.2 | 21.2 |
| | | 1a + 1b + 1c | 34.5 | 34.5 | 34.5 | 34.5 | 34.5 | 34.5 | 34.5 | 34.5 |
| | Hardness (JIS-C) | 1a | 85 | 85 | 85 | 85 | 60 | | 63 | 88 |
| | | 1b | 60 | 60 | 60 | 60 | 70 | | 88 | 78 |
| | | 1c | 82 | 82 | 85 | 85 | 85 | 87 | 85 | 63 |
| Cover | Thickness (mm) | | 2.2 | 2.2 | 2.2 | 2.2 | 2.2 | 2.2 | 2.2 | 2.2 |
| Ball | Diameter (mm) | | 42.7 | 42.7 | 42.7 | 42.7 | 42.7 | 42.7 | 42.7 | 42.7 |
| | Weight (g) | | 45.2 | 45.2 | 45.2 | 45.2 | 45.2 | 45.2 | 45.2 | 45.2 |
| | Carry (m) *1 | | 174.5 | 174.8 | 174.0 | 174.4 | 174.9 | 174.1 | 173.5 | 172.2 |
| | Number of spinning rotation (rpm) *2 | | 3020 | 3110 | 3130 | 3220 | 3180 | 3590 | 3420 | 3400 |
| | Hitting feeling *3 | Wood 1W | ◎ | ◎ | ◎ | ○ | ○ | X | X | ○ |
| | | Iron 91 | ○ | ○ | ◎ | ◎ | ◎ | X | X | ○ |

two-piece solid golf ball concerning Comparative Example 1. The solid golf balls concerning Examples 1 to 5 were evaluated such that they gave good hitting feelings.

On the contrary, the solid golf ball concerning Comparative Example 2 gave a bad hitting feeling, because the intermediate layer of the solid core was excessively hard. The solid golf ball concerning Comparative Example 3 failed to give a sufficient carry, because the outer layer of the solid core was softer than the intermediate layer.

EXAMPLES 6 to 9 CONCERNING THE SECOND INVENTION

Rubber compositions for inner layers 3*a* blended as shown in Table 5 were heated and molded in a mold under a pressurized condition to form the inner layers 3*a*. Each of intermediate layers 3*b* was provided on each of outer surfaces of the obtained inner layers 3*a* by means of injection molding with a thermoplastic polyamide elastomer. Next, hemispherical shells in semi-vulcanized states were formed from resin compositions for outer layers 3*c* blended as shown in Table 5. Each of outer surfaces of the intermediate layers 3*b* was coated with the hemispherical shells, followed by heating and molding in a mold under a pressurized condition to provide the outer layer 3*c*. Thus solid cores 3 having the three-layered structure were produced. Each of the solid cores 3 was subjected to injection molding on its outer surface with a resin composition for a cover 4 obtained by blending 1.5 part by weight of titanium dioxide with respect to 100 parts by weight of an ionomer resin, followed by being subjected to polishing and painting to produce solid golf balls concerning Examples 6 to 9.

EXAMPLES 10 TO 12 CONCERNING THE SECOND INVENTION AND COMPARATIVE EXAMPLE 5

Solid golf balls concerning Examples 10 to 12 and Comparative Example 5 were produced in the same manner as Examples 6 to 9 except that mixtures of a thermoplastic polyamide elastomer and an ionomer blended as shown in Table 5 were used for intermediate layers 3*b*.

COMPARATIVE EXAMPLE 4

A conventional two-piece solid golf ball was produced such that a solid core having a single-layered structure produced from a rubber composition blended as shown in Table 5 was subjected to injection molding on its outer surface with the resin composition for the cover used in Examples 6 to 9, followed by being subjected to polishing and painting.

COMPARATIVE EXAMPLE 6

A solid golf ball was produced in the same manner as Examples 6 to 9 except that a thermoplastic polyamide elastomer harder than those used in Examples 6 to 9 was used for an intermediate layer 3*b*.

TABLE 5

| | | Example | | | | | | | Comparative Example | | |
|---|---|---|---|---|---|---|---|---|---|---|---|
| | | 6 | 7 | 8 | 9 | 10 | 11 | 12 | 4 | 5 | 6 |
| Composition for inner layer 3a | Polybutadiene | 100 | 100 | 100 | 100 | 100 | 100 | 100 | | 100 | 100 |
| | Zinc acrylate | 10 | 7 | 15 | 10 | 10 | 10 | 10 | | 10 | 10 |
| | Zinc oxide | 65 | 66 | 63 | 65 | 65 | 65 | 65 | | 65 | 65 |
| | Anti-aging agent | 0.5 | 0.5 | 0.5 | 0.5 | 0.5 | 0.5 | 0.5 | | 0.5 | 0.5 |
| | Peroxide | 1.2 | 1.2 | 1.2 | 1.2 | 1.2 | 1.2 | 1.2 | | 1.2 | 1.2 |
| Composition for intermediate layer 3b | Thermoplastic polyamide elastomer A*4 | 100 | 100 | 100 | 100 | 80 | 80 | 60 | | 80 | |
| | Thermoplastic polyamide elastomer B*5 | | | | | | | | | | 100 |
| | Himilan 1605 *6 | | | | | 20 | 20 | 40 | | 20 | |
| Composition for outer layer 3c | Polybutadiene | 100 | 100 | 100 | 100 | 100 | 100 | 100 | 100 | 100 | 100 |
| | Zinc acrylate | 37 | 37 | 37 | 28 | 37 | 28 | 37 | 37 | 20 | 37 |
| | Zinc oxide | 5 | 5 | 5 | 5 | 5 | 5 | 5 | 18 | 5 | 5 |
| | Anti-aging agent | 0.5 | 0.5 | 0.5 | 0.5 | 0.5 | 0.5 | 0.5 | 0.5 | 0.5 | 0.5 |
| | Peroxide | 1.5 | 1.5 | 1.5 | 1.5 | 1.5 | 1.5 | 1.5 | 1.5 | 1.5 | 1.5 |

In Table 5, symbols are as follows:

*4: polyether-polyamide block copolymer, Shore D hardness of 25;

*5: polyether-polyamide block copolymer, Shore D hardness of 63;

*6: trade name, ionomer resin of sodium salt of ethylene-methacrylic acid copolymer produced by Du Pont-Mitsui Polychemical, Shore D hardness of 65.

The initial velocity and the hitting feeling were investigated and shown in Table 6 for the solid golf balls concerning Examples 6 to 12 and Comparative Examples 4 to 6. As shown in Table 6, the solid golf balls concerning Examples 6 to 12 gave initial velocities approximately equivalent to or more than an initial velocity given by using the conventional two-piece solid golf ball concerning Comparative Example 4. Therefore, the solid golf balls concerning Examples 6 to 12 were excellent in resilience. Further, the solid golf balls concerning Examples 6 to 12 were evaluated such that they gave good hitting feelings.

On the contrary, the solid golf ball concerning Comparative Example 5 was poor in resilience, because the outer layer of the solid core was soft. The solid golf ball concerning Comparative Example 6 gave a bad hitting feeling and it was poor in resilience, because the intermediate layer of the solid core was formed of the hard thermoplastic polyamide elastomer having a Shore D hardness of 63.

TABLE 6

| | | | Example | | | | | | | Comparative Example | | |
|---|---|---|---|---|---|---|---|---|---|---|---|---|
| | | | 6 | 7 | 8 | 9 | 10 | 11 | 12 | 4 | 5 | 6 |
| Core | Diameter (mm) | 3a | 25.0 | 25.0 | 25.0 | 25.0 | 25.0 | 25.0 | 25.0 | | 25.0 | 25.0 |
| | | 3a + 3b | 28.0 | 28.0 | 28.0 | 28.0 | 28.0 | 28.0 | 28.0 | | 28.0 | 28.0 |
| | | 3a + 3b + 3c | 38.3 | 38.3 | 38.3 | 38.3 | 38.3 | 38.3 | 38.3 | 38.3 | 38.3 | 38.3 |
| | Weight (g) | 3a | 11.3 | 11.4 | 11.3 | 11.3 | 11.3 | 11.3 | 11.3 | | 11.3 | 11.3 |
| | | 3a + 3b | 14.5 | 14.6 | 14.4 | 14.5 | 14.5 | 14.5 | 14.5 | | 14.5 | 14.5 |
| | | 3a + 3b + 3c | 34.2 | 34.3 | 34.2 | 34.2 | 34.2 | 34.1 | 34.2 | 34.3 | 34.1 | 34.2 |
| | Hardness | 3a | 55 | 43 | 61 | 55 | 55 | 55 | 55 | | 55 | 55 |
| | (JIS-C) | 3b | 57 | 57 | 57 | 57 | 73 | 73 | 78 | | 73 | 97 |
| | | 3c | 90 | 90 | 90 | 77 | 90 | 77 | 90 | 90 | 61 | 90 |
| Cover | Thickness (mm) | | 2.3 | 2.3 | 2.3 | 2.3 | 2.3 | 2.3 | 2.3 | 2.3 | 2.3 | 2.3 |
| Ball | Diameter (mm) | | 42.8 | 42.8 | 42.9 | 42.8 | 42.8 | 42.8 | 42.9 | 42.8 | 42.9 | 42.9 |
| | Weight (g) | | 45.2 | 45.2 | 45.3 | 45.2 | 45.2 | 45.2 | 45.2 | 45.2 | 45.2 | 45.2 |
| | Initial velocity (feet/sec) *7 | | 254.0 | 253.3 | 253.5 | 253.2 | 253.7 | 253.1 | 253.0 | 253.1 | 252.2 | 252.3 |
| | Hitting feeling *8 | | ◎ | ◎ | ◎ | ◎ | ◎ | ◎ | ○ | x | ○ | x |

In Table 6, symbols are as follows:

*7: measured by using a method in accordance with the initial velocity test recommended by U.S.G.A. (United States Golf Association); the larger the numerical value is, the better the resilience is;

*8: evaluated by actually hitting the ball by an expert golfer (man); ◎→extremely good, ○→good, X→bad.

What is claimed is:

1. A solid golf ball comprising a solid core having a three-layered structure composed of an inner layer, an intermediate layer, and an outer layer, and a cover for coating said solid core, wherein:

said intermediate layer is designed to have a JIS-C hardness of 50 to 80, and said outer layer is designed to have a hardness which is higher than said hardness of said intermediate layer.

2. The solid golf ball according to claim 1, wherein said inner layer is designed to have a JIS-C hardness of 60 to 95, and said outer layer is designed to have a JIS-C hardness of not less than 65.

3. The solid golf ball according to claim 1, wherein said intermediate layer has a thickness of 1 to 13 mm, and said inner layer and said intermediate layer are designed to have a combined diameter of 21 to 39 mm.

4. The solid golf ball according to claim 1, wherein said solid core is formed of a rubber composition comprising a base material of a natural rubber or a synthetic rubber.

5. The solid golf ball according to claim 1, wherein said inner layer is designed to have a diameter of 6 to 30 mm, and said solid core is designed to have a diameter of 37 to 41 mm.

6. A solid golf ball comprising a solid core having a three-layered structure composed of an inner layer, an intermediate layer, and an outer layer, and a cover (4) for coating said solid core, wherein:

said inner layer is designed to have a JIS-C hardness of 40 to 90, said intermediate layer is formed of a thermoplastic resin composition and designed to have a JIS-C hardness of 50 to 80, and said outer layer is designed to have a JIS-C hardness of not less than 65.

7. The solid golf ball according to claim 6, wherein said thermoplastic resin for forming said intermediate layer is composed of a thermoplastic polyamide elastomer.

8. The solid golf ball according to claim 6, wherein said thermoplastic resin for forming said intermediate layer is blended in an amount of not less than 50% by weight with respect to a total weight of said thermoplastic resin composition.

9. The solid golf ball according to claim 6, wherein said thermoplastic resin for forming said intermediate layer is designed to have a Shore D hardness of 20 to 50.

10. The solid golf ball according to claim 6, wherein said outer layer is designed to have a JIS-C hardness of 65 to 97.

11. The solid golf ball according to claim 6, wherein said inner layer and said outer layer are formed of rubber compositions comprising base materials composed of cis-1, 4-polybutadiene.

12. The solid golf ball according to claim 6, wherein said intermediate layer has a thickness of 1 to 5 mm, and said inner layer and said intermediate layer are designed to have a combined diameter of 26 to 39 mm.

13. The solid golf ball according to claim 6, wherein said inner layer is designed to have a diameter of 17 to 30 mm, and said solid core is designed to have a diameter of 37 to 41 mm.

* * * * *